US007583566B2

(12) United States Patent
Yan

(10) Patent No.: US 7,583,566 B2
(45) Date of Patent: Sep. 1, 2009

(54) ELECTRONIC DEVICE WITH AN ELECTROLUMINESCENCE LENS MASK

(75) Inventor: Yiu-Fai Yan, Yuen Long (HK)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 11/519,140

(22) Filed: Sep. 11, 2006

(65) Prior Publication Data

US 2008/0062821 A1 Mar. 13, 2008

(51) Int. Cl.
*G04B 19/30* (2006.01)
*G04B 19/32* (2006.01)

(52) U.S. Cl. ..... 368/227; 368/67; 368/226

(58) Field of Classification Search ..... 368/223, 368/227, 226, 67
See application file for complete search history.

(56) References Cited

U.S. PATENT DOCUMENTS 3,043,038 A * 7/1962 Marble ..... 40/546
4,044,708 A * 8/1977 Klein ..... 116/328
4,527,096 A 7/1985 Kindlmann
4,775,964 A 10/1988 Alessio et al.
6,515,416 B1 2/2003 Chico
6,751,898 B2 * 6/2004 Heropoulos et al. ..... 40/544
2004/0233788 A1 * 11/2004 Plancon et al. ..... 368/11
2006/0090384 A1 * 5/2006 Woodruff ..... 40/544
2006/0291186 A1 * 12/2006 Marcus et al. ..... 362/84
2008/0066357 A1 * 3/2008 Spero et al. ..... 40/575

* cited by examiner

*Primary Examiner*—Renee S Luebke
*Assistant Examiner*—Thanh S Phan
(74) *Attorney, Agent, or Firm*—Carmody & Torrance LLP

(57) ABSTRACT

An illumination assembly for an electronic device, wherein the electronic device comprises a casing within which is positioned at least a display assembly for displaying information, wherein the illumination assembly comprises an electroluminescent assembly, coupled in the module, having a first surface and a second surface, wherein the first surface is in facing alignment with the display assembly; a translucent ink/film layer having a first surface and a second surface, wherein the first surface is positioned in facing alignment with the second surface of the electroluminescent assembly, and wherein the translucent ink/film layer has indicia therein or surface indicia thereon; a lens in facing alignment with the second surface of the translucent ink/film layer; wherein the illumination assembly is sealed in the module; and whereby upon illumination of the electroluminescent assembly, the visibility of the indicia is facilitated. In a specific embodiment, the wearable electronic device is a wristwatch.

18 Claims, 3 Drawing Sheets

ELECTRONIC DEVICE WITH AN ELECTROLUMINESCENCE LENS MASK

BACKGROUND OF THE INVENTION

This invention relates generally to electronic devices that incorporate electroluminescent (EL) technology, such as wristworn devices, and in particular, to a wearable electronic device that incorporates an EL layer above the dial so as to facilitate the illumination of indicia, whether embedded and/or surface indicia (as disclosed below), under low lighting conditions.

Electroluminescent (EL) technology is well known in wristwatches, a pioneer in the field being companies such as Timex Corporation. The construction of such EL lamps is now well known, and is further described in several, if not many existing patents, examples of which can be found in U.S. Pat. Nos. 4,527,096 and 6,515,416.

However, these (and presumably other) patents are believed to focus only on the use of EL technology for backlighting of the dial or display, such as an LCD. That is, the present inventor is not aware of any use of EL technology (i.e. as a lamp) wherein the lamp/layer is positioned in front of the dial or display so as to facilitate illumination of (e.g.) embedded and/or surface indicia, not on the dial or LCD display, during low lighting conditions.

Such a device, however, is believed to be desirable in that it further facilitates the use and reading of the device's functions during low lighting conditions, thereby providing at the least, increased functionality, ease of use and enjoyment of the device. The present invention provides the aforementioned advantages and objectives, as well as those set forth below.

SUMMARY AND OBJECTIVES OF THE INVENTION

It is thus an objective of the present invention to overcome the perceived deficiencies in the prior art.

It is another objective and advantage of the present invention to provide an electronic device that facilitates its use in low lighting conditions. For example, it is an objective and advantage of the present invention to provide an EL lamp in front of the display or dial in such a way as to facilitate the reading/viewability of, for example, embedded and/or surface indicia in and/or on a translucent ink/film layer.

Still other objects and advantages of the invention will in part be obvious and will in part be apparent from the specification.

The invention accordingly comprises the features of construction, combination of elements and arrangement of parts and sequence of steps which will be exemplified in the construction, illustration and description hereinafter set forth, and the scope of the invention will be indicated in the claims.

To carry out the advantages and objectives set forth above and below, the present invention, generally speaking, in a first embodiment, is directed to an illumination assembly for an electronic device, wherein the electronic device comprises a casing within which is positioned at least a display assembly for displaying information, wherein the illumination assembly comprises an electroluminescent assembly, coupled in the casing, having a first surface and a second surface, wherein the first surface is in facing alignment with the display assembly; a translucent ink/film layer having a first surface and a second surface, wherein the first surface is positioned in facing alignment with the second surface of the electroluminescent assembly, and wherein the second surface of the translucent ink/film layer has surface indicia thereon; a lens in facing alignment with the second surface of the translucent ink/film layer; wherein the illumination assembly is sealed in the casing; and whereby upon illumination of the electroluminescent assembly, the visibility of the surface indicia is facilitated.

In an alternative embodiment, the present invention is directed to an illumination assembly for an electronic device, wherein the electronic device comprises a casing within which is positioned at least a display assembly for displaying information, wherein the illumination assembly comprises an electroluminescent assembly, coupled in the casing, having a first surface and a second surface, wherein the first surface is in facing alignment with the display assembly; a translucent ink/film layer having a first surface and a second surface, wherein the first surface is positioned in facing alignment with the second surface of the electroluminescent assembly, and wherein the translucent ink/film layer has indicia therein; a lens in facing alignment with the second surface of the translucent ink/film layer; wherein the illumination assembly is sealed in the casing; and whereby upon illumination of the electroluminescent assembly, the visibility of the indicia is facilitated.

In a specific embodiment, the wearable electronic device is a wristwatch.

BRIEF DESCRIPTION OF THE DRAWINGS

The above set forth and other features of the invention are made more apparent in the ensuing Description of the Preferred Embodiments when read in conjunction with the attached Drawings, wherein.

Like reference numerals used in the various figures represent like parts or elements, but not every part or element in each figure may be indicated with a reference numeral.

DETAILED DESCRIPTION OF THE PREFERRED EMBODIMENTS

Figure 1:
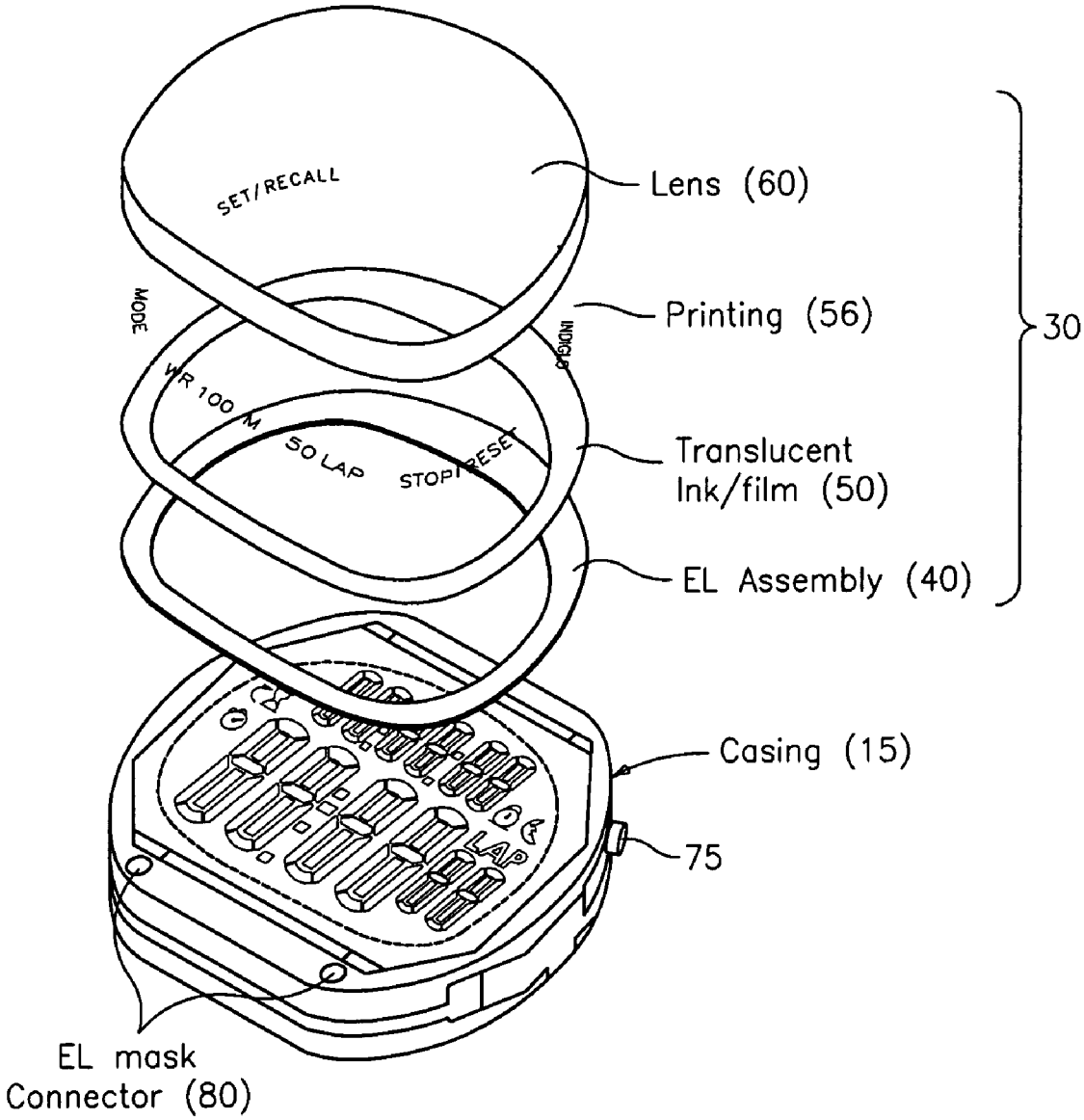
FIG. 1 is an exploded view of an electronic device constructed in accordance with the present invention, illustrating an illumination assembly constructed in accordance with the present invention.
Figure 2:
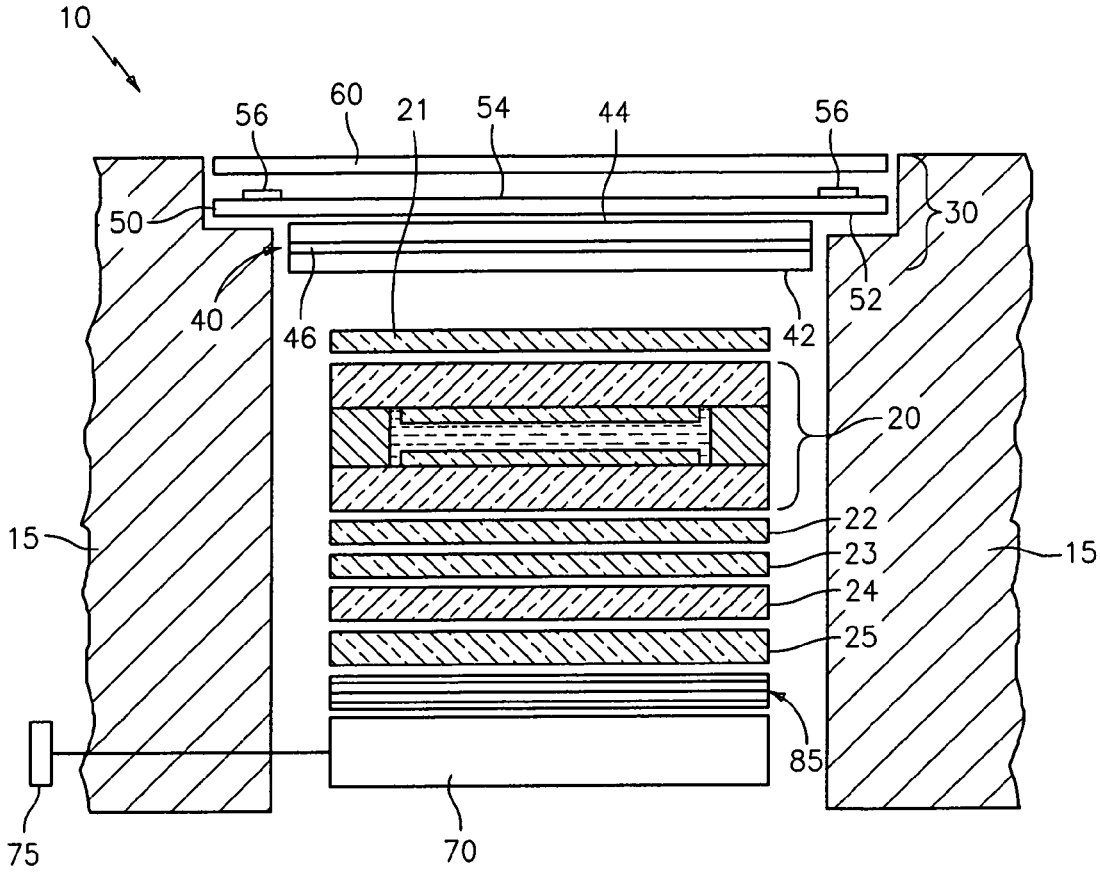
FIG. 2 is a simplified cross-sectional view of FIG. 1.

Reference is first made to FIGS. 1 and 2, which are respectively exploded and cross-sectional views of a wearable electronic device, generally indicated at 10, constructed in accordance with the present invention.

Generally speaking, in accordance with a first embodiment, wearable electronic device 10 ("device 10") comprises a module or casing, generally indicated at 15, within which is positioned, among other features and elements, a display assembly for displaying information. As will be understood, the display assembly may comprise a dial and display hands, such as that disclosed in U.S. Pat. No. 4,775,964, the subject matter of which is incorporated by reference as if fully set forth herein, or may comprise a liquid crystal display, such as that indicated by reference 20 and as illustrated in the figures. As would be readily known to those skilled in the art, use of one or more display hands permits for the display of information in an "analog" manner, while use of a liquid crystal display permits the display of information in a "digital" manner.

Also, while a specific embodiment of the present invention is that the wearable electronic device is a wristwatch, the present invention is not limited thereby and may be in the form of and/or have functionality related to for example and not limitation, altitude, temperature or compass measurements, barometric pressure, a heart rate display, blood pressure (and/or combinations thereof), the display of tide information, sunset information, moon phases, medical information such as when medicine should be taken and how many pills at each time interval or any other information that could be displayed on a liquid crystal display, such as a counter/timer or any one of additional parameters such as water pressure, water depth and oxygen left in a diver's tank (i.e. a diver's watch); object finder (i.e. to find one's car or way back to a starting location); blood/sugar levels (a glucometer); speed and distance (a runner's watch); and any combination of the foregoing, all of which may be in addition to or in the absence of conventional timekeeping functionality.

In accordance with the present invention, device 10 also comprises an illumination assembly, generally indicated at 30, within casing 15. FIGS. 1 and 2 best illustrate the specifics of illumination assembly 30.

In particular, illumination assembly 30, comprising an electroluminescent assembly generally indicated at 40, is preferably mounted (e.g. coupled) in casing 15, and protected from dirt, dust and/or water by known sealing methodologies and construction. Electroluminescent assembly 40, after accounting for all the layers as more particularly defined herein, has a bottom surface 42 and a top surface 44, with bottom surface 42 in facing alignment with display assembly 20.

Illumination assembly 30 also comprises a translucent ink/film layer 50. Layer 50 also has a bottom surface 52 and a top surface 54, wherein the bottom surface 52 is positioned in facing alignment with the top surface 44 of electroluminescent assembly 40. Additionally, in a preferred embodiment, top surface 54 of translucent ink/film layer 50 has indicia, such as surface indicia 56, thereon. In a preferred embodiment, surface indicia 56 is printed on translucent ink/film layer 50, but depositing it on layer 50 can also be by painting and/or silk-screening by way of example and not limitation, using conventional techniques well known in the art. Examples of such surface indicia contemplated by the present invention can be terms to facilitate use of the device, such as but not limited to: "MODE," "SET/RECALL," "STOP/RESET" and "LIGHT" just to name a few. Additionally, the indicia could comprise other graphics, patterns or decorations or ornamentation, such as the flowers indicated by reference numeral 57 and illustrated in FIGS. 3-5. Additionally, the indicia could also be provided (e.g. embedded) within ink/film layer 50 by known processing techniques such that it is illuminateable as disclosed below.

Illumination assembly 30 further comprises a lens 60, which is in facing alignment with top surface 54 of translucent ink/film layer 50. Lens 60 is preferably clear (i.e. made of glass or plastic) to ensure good visibility of dial assembly 20 and surface indicia 56. Ink/film layer 50 could be assembled with or applied to lens 60 either before or after lens 60 has been mounted and/or sealed within casing 15.

As constructed, upon illumination of electroluminescent assembly 40 and more technically speaking, upon energizing of an EL layer 46 in electroluminescent assembly 40, visibility of the indicia, whether embedded or surface indicia 56, is facilitated.

Also, electroluminescent assembly 40 could be mounted with the module 15, or mounted with ink/film layer film 50, or mounted directly with lens 60 wherein ink/film layer 50 has been applied to the surface of the lens 60.

Yet further, ink/film layer 50 could be multilayered or designed to create three (3) dimensional patterns, decorations and/or graphics to create visual depth or layering effects for enhanced aesthetics.

To energize EL layer 46, well known circuitry can be implemented. For example, U.S. Pat. No. 4,527,096, the subject matter of which is incorporated by reference as if fully set forth herein, describes a suitable driving circuit for energizing EL layer 46. Reference numeral 70 generally indicates the controller/circuitry means for such functions as timekeeping or other functionality to achieve the objectives set forth above (e.g. heartrate monitoring/display, etc.), along with the controller and driving circuitry for illumination of electroluminescent assembly 40. Batteries and/or another suitable power source, while not shown, is contemplated, and its electrical coupling to a suitable drive circuit is believed to be well-known to those skilled in the art. A pusher 75, operatively coupled to controller/circuitry 70, is provided to selectively initiate the illumination of at least electroluminescent assembly 40.

As illustrated, in FIG. 2, the preferred embodiment provides for the positioning of the electrical circuitry and power source for electroluminescent assembly 40 to be within module 15. As such, wires and/or other electrical connections (e.g. pads, traces, etc.) can be used to electrically couple the driving circuit to electroluminescent assembly 40. For example, FIG. 1 illustrates the use of connectors 80 for providing the electrical coupling to electroluminescent assembly 40.

Although not material to the present invention but to distinguish the inventive features from the conventional use of EL technology, FIG. 2 illustrates the incorporation of a backlighting arrangement, also comprising an EL assembly, generally indicated at 85. The layering of such an EL assembly is both well known to those skilled in the art and non-material to the present invention. A plurality of additional layers, such as polarizing films 21 and 22, a retardation film 23 a cholesteric liquid crystal polymer sheet 24 and/or a translucent light absorbing layer 25 may also be provided or eliminated as the case may be and as would be well understood by one skilled in the art.

Figures 3, 4, 5:
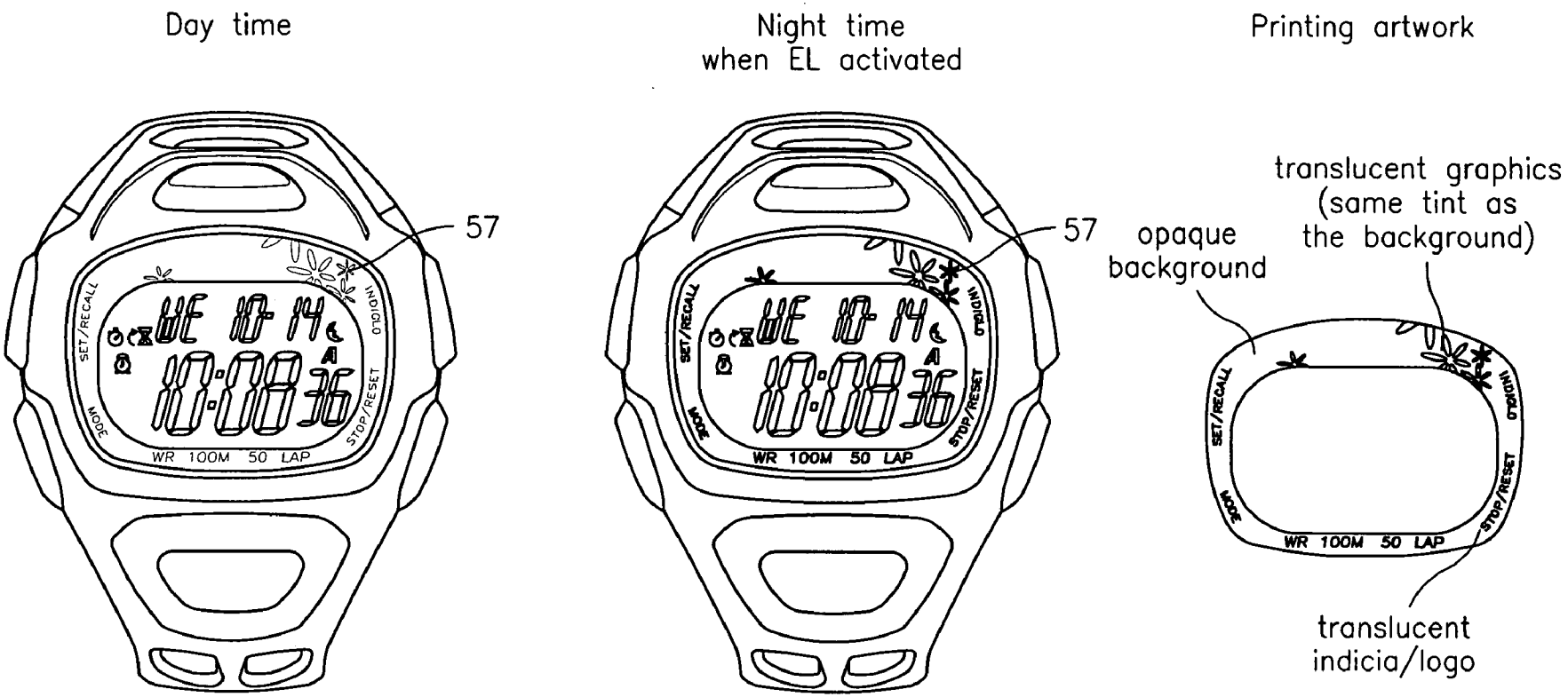
FIG. 3 illustrates the electronic device of FIG. 1 under normal lighting conditions.
FIG. 4 illustrates the electronic device of FIG. 1, and in particular, exemplary indicia being illuminated under low lighting conditions.
FIG. 5 illustrates an exemplary ink/film layer 50.

FIG. 3 shows device 10 using the construction set forth in FIGS. 1 and 2 during normal lighting conditions (e.g. showing an example of how the indicia may be all or partially hidden during such normal lighting conditions) while FIG. 4 illustrates the construction set forth in FIGS. 1 and 2 during an illumination of assembly 40 during low lighting conditions. Specifically, it can be seen that illumination of EL layer 46 provides for the illumination of the indicia, whether surface indicia 56 or embedded indicia. As a non-material feature of the invention, display 20 can be a negative display (light segments on a dark background) or a positive display (dark segments on a light background).

It will thus be seen that the present invention is both patentably different from and a significant improvement over known devices. Specifically, the present invention provides a unique way to illuminate indicia provided, for example, in or on a translucent ink/film layer that is above display 20. The present invention provides at the least, increased functionality, ease of use and enjoyment of the device.

While the invention has been particularly shown and described with respect to preferred embodiments thereof, it will be understood by those skilled in the art that changes in form and details may be made therein without departing from the scope and spirit of the invention.

Lastly, the preferred embodiment of the present invention is incorporated into a timepiece and a wristwatch in particular. The electronic device thus being a timepiece such as a wristwatch will thus comprise other features and parts, omitted herein for purposes of brevity. Also, the use of conventional references such as "top" and "bottom" are used only for ease of disclosing the present invention and are not intended to limit the scope thereof. The spacing shown between layers and/or the relative size of the layers in FIGS. 1 and 2 are merely for convenience and do not represent any specific dimensions.

What is claimed is:

1. A wearable electronic device comprising:

a casing within which is positioned at least a first display assembly for displaying information, wherein the first display assembly comprises at least one of(i) a liquid crystal display for displaying said information in a digital manner and (ii) a dial and at least one display hand for displaying said information in an analog manner; and a second display assembly that is separate from and perimeters the first display assembly, wherein the second display assembly comprises:

an electroluminescent assembly, coupled in the casing, having a first surface and a second surface, wherein the first surface is in facing alignment with the first display assembly;

a translucent ink/film layer having a first surface and a second surface, wherein the first surface is positioned in facing alignment with the second surface of the electroluminescent assembly, and wherein the second surface of the translucent ink/film layer has surface indicia thereon;

a lens in facing alignment with the second surface of the translucent ink/film layer;

wherein the second display assembly is sealed in the casing; and whereby upon illumination of the electroluminescent assembly, the visibility of the surface indicia is facilitated.

2. The wearable electronic device as claimed in claim 1, wherein:

the translucent ink/film layer is positioned directly on the second surface of the electroluminescent assembly, and the lens is positioned directly on the second surface of the translucent ink/film layer.

3. The wearable electronic device as claimed in claim 2, wherein the surface indicia is printed on the second surface of the translucent ink/film layer.

4. The wearable electronic device as claimed in claim 1, wherein the electroluminescent assembly comprises an energizable EL layer, wherein the illumination assembly comprises:

means, operatively coupled to the electroluminescent assembly, for energizing the EL layer.

5. The wearable electronic device as claimed in claim 1, comprising means, operatively coupled to the electroluminescent assembly, for illuminating an EL layer positioned therein, whereby upon illumination of the EL layer assembly, the visibility of the surface indicia is facilitated.

6. The wearable electronic device as claimed in claim 1, wherein the display assembly comprises a dial and at least one display band for displaying information in an analog manner.

7. The wearable electronic device as claimed in claim 6, wherein the at least one display hand is a minute or an hour hand.

8. The wearable electronic device as claimed in claim 1, wherein the display assembly comprises a liquid crystal display for displaying information in a digital manner.

9. The wearable electronic device as claimed in claim 1, wherein the wearable electronic device is a wristwatch.

10. A wearable electrode device comprising:

a casing within which is positioned at least a first display assembly for displaying information, wherein the first display assembly comprises at least one of (i) a liquid crystal display for displaying said information in a digital manner and (ii) a dial and at least one display hand for displaying said information in an analog manner; and a second display assembly that is separate from and perimeters the first display assembly, wherein the second display assembly comprises:

an electroluminescent assembly, coupled in the casing, having a first surface and a second surface, wherein the first surface is in facing alignment with the first display assembly;

a translucent ink/film layer having a first surface and a second surface, wherein the first surface is positioned in facing alignment with the second surface of the electroluminescent assembly, and wherein the translucent ink/film layer has indicia therein;

a lens in facing alignment with the second surface of the translucent ink/film layer;

wherein the second display assembly is sealed in the casing; and whereby upon illumination of the electroluminescent assembly, the visibility of the indicia is facilitated.

11. The wearable electronic device as claimed in claim 10, wherein the indicia is embedded within the translucent ink/film layer.

12. The wearable electronic device as claimed in claim 10, wherein the electroluminescent assembly comprises an energizable EL layer, wherein the illumination assembly comprises:

means, operatively coupled to the electroluminescent assembly, for energizing the EL layer.

13. The wearable electronic device as claimed in claim 10, comprising means, operatively coupled to the electroluminescent assembly, for illuminating an EL layer positioned therein, whereby upon illumination of the EL layer assembly, the visibility of the indicia is facilitated.

14. The wearable electronic device as claimed in claim 10, wherein the display assembly comprises a dial and at least one display band for displaying information in an analog manner.

15. The wearable electronic device as claimed in claim 14, wherein the at least one display hand is a minute or an hour hand.

16. The wearable electronic device as claimed in claim 10, wherein the display assembly comprises a liquid crystal display for displaying information in a digital manner.

17. The wearable electronic device as claimed in claim 10, wherein the wearable electronic device is a wristwatch.

18. A wearable electronic device comprising:

a module within which is positioned at least a first display assembly for displaying information, wherein the first display assembly comprises at least one of (i) a liquid crystal display digital for displaying said information in a digital manner and (ii) a dial and at least one display hand for displaying said information in an analog manner; and a second display assembly comprising:

an electroluminescent assembly, coupled in the casing, having a first surface and a second surface, wherein the first surface is in facing alignment with the first display assembly;

a translucent ink/film layer having a first surface and a second surface, wherein the first surface is positioned in facing alignment with the second surface of the electroluminescent assembly, and wherein the second surface of the translucent ink/film layer has surface indicia at least one of thereon and therein;

a lens in facing alignment with the second surface of the translucent ink/film layer;

wherein the second display assembly is sealed in the casing;

wherein the wearable electronic device is a wristwatch; and whereby upon illumination of the electroluminescent assembly, the visibility of the surface indicia is facilitated.

* * * * *

UNITED STATES PATENT AND TRADEMARK OFFICE

CERTIFICATE OF CORRECTION

PATENT NO. : 7,583,566 B2
APPLICATION NO. : 11/519140
DATED : September 1, 2009
INVENTOR(S) : Yiu-Fai Yan It is certified that error appears in the above-identified patent and that said Letters Patent is hereby corrected as shown below:

Column 5

Line 22, Claim 1 delete "of(i)" and replace it with --of (i)--

Column 6

Line 3, Claim 6 delete "band" and replace it with --hand--
Line 54, Claim 14 delete "band" and replace it with --hand--

Signed and Sealed this

Sixth Day of October, 2009

David J. Kappos

David J. Kappos
*Director of the United States Patent and Trademark Office*